US008540404B2

(12) United States Patent
Robinson et al.

(10) Patent No.: US 8,540,404 B2
(45) Date of Patent: Sep. 24, 2013

(54) FLASHLIGHT WITH RETRACTABLE CORD AND ATTACHMENT DEVICE

(75) Inventors: Glenn Robinson, Parkland, FL (US); Michael Garcia, Coral Springs, FL (US)

(73) Assignee: IBT Holdings, LLC, Deerfield Beach, FL (US)

( * ) Notice: Subject to any disclaimer, the term of this patent is extended or adjusted under 35 U.S.C. 154(b) by 0 days.

(21) Appl. No.: 13/385,556

(22) Filed: Feb. 24, 2012

(65) Prior Publication Data

US 2012/0275143 A1 Nov. 1, 2012

Related U.S. Application Data

(60) Provisional application No. 61/464,005, filed on Feb. 28, 2011.

(51) Int. Cl.
*F21V 27/00* (2006.01)

(52) U.S. Cl.
USPC ..... 362/387; 362/191; 362/398

(58) Field of Classification Search
USPC ..... 362/190, 191, 202, 208, 258, 387, 362/398
See application file for complete search history.

(56) References Cited

U.S. PATENT DOCUMENTS

| | | | | |
|---|---|---|---|---|
| 6,003,472 | A * | 12/1999 | Matt et al. | 362/190 |
| 7,824,083 | B2 * | 11/2010 | Fullerton et al. | 362/398 |
| 2002/0135999 | A1 * | 9/2002 | Chen | 362/208 |

* cited by examiner

*Primary Examiner* — Y My Quach Lee
(74) *Attorney, Agent, or Firm* — Dan M. DeLaRosa

(57) ABSTRACT

A flashlight with an extendable and retractable cord is provided, and the flashlight comprises: a housing with an internal cavity leading to an aperture, a light bulb, a power source, an extendable and retractable cord scrollably received within a portion of the internal cavity of the housing, one end of the cord is attached to a portion of the internal cavity of the housing and the second end extending through said aperture and being connected to an attachment device.

13 Claims, 5 Drawing Sheets

FLASHLIGHT WITH RETRACTABLE CORD AND ATTACHMENT DEVICE

RELATED APPLICATION

This application is related to Provisional Application Ser. No. 61/464,005 entitled "Flashlight with Retractable Cord and Attachment Device" filed on Feb. 28, 2011.

BACKGROUND OF THE INVENTION

1. Field of the Invention

This invention relates to a flashlight comprising a housing with an internal cavity leading to an aperture, a light bulb, a power source, an extendable and retractable cord scrollably received within a portion of the internal cavity of the housing, one end of the cord is attached to a portion of the internal cavity of the housing and the second end extending through said aperture and being connected to an attachment device such as rings, clips, clamps, carabineer, lanyards and straps.

2. Description of the Related Art

There are flashlights with mechanisms such as clips and other device that allows a flashlight to be attached to user.

SUMMARY OF THE INVENTION

In one embodiment, the present invention provides for a flashlight comprising: a housing having top and bottom portions and an internal cavity, the top portion comprising at least one light bulb, the bottom portion comprising at least one aperture, the internal cavity of the housing leading to the aperture; a power source compartment situated within the internal cavity of the housing; an extendable and retractable cord having opposing ends; at least one cord holding compartment situated with the internal cavity of the housing and adjacent to the bottom portion of the housing, the cord is scrollably received within the cord holding compartment, one end of the cord is attached to a portion of the cord holding compartment and the other end extending through the aperture and receiving an attachment device.

In another embodiment, the attachment device is selected from a group consisting essentially of rings, clips, clamps, carabineer, lanyards and straps. In yet another embodiment, the bottom portion of the housing comprises a bottom surface, the aperture is situated on the bottom surface of the bottom portion of the housing.

In still another embodiment, the top portion of the housing comprises at least one transparent lens to allow light emitted by the bulb to be shined by the flashlight. In still yet another embodiment, the top portion of the housing comprises at least one translucent lens to allow light emitted by the bulb to be shined by the flashlight.

In a further embodiment, the flashlight further comprises a reflector situated adjacent the bulb to further amply and reflect light emitted by the bulb. In yet a further embodiment, the flashlight further comprises at least one on/off button situated on the surface of the housing, at least one power source, the power source is a battery.

In still a further embodiment, the flashlight further comprises at least one magnet. In still yet a further embodiment, the housing comprises an extended top portion, and the magnet is attached to an external surface of the extended top portion. In another further embodiment, the housing comprises an extended bottom portion, and the magnet is attached to an external surface of the extended bottom portion. In another embodiment, the bottom portion of the housing comprised an extended bottom portion, and the extended bottom portion has a surface area, and the flashlight comprises a second magnet, and the second magnet is situated on the surface area of the extended bottom portion. In yet another embodiment, the extended top portion comprises at least one ring which is designed to rotate about the housing of the flashlight, and the magnet is attached to at least a portion of the ring. In still another embodiment, the extended bottom comprises at least one ring which is designed to rotate about the housing of the flashlight, and the magnet is attached to at least a portion of the ring.

In still yet another embodiment, the present invention provides for a flashlight comprising: a housing having top and bottom portions and an internal cavity leading to an aperture, and the top portion comprises a light bulb; a power source compartment situated within the internal cavity of the housing; an extendable and retractable cord has first and second ends, and the cord is scrollably received within a portion of the internal cavity of the housing, and the first end of the cord is attached to a portion of the internal cavity of the housing and the second end extending through the aperture; and an attachment device connected to the second end of the cord.

In a further embodiment, the flashlight further comprising a device for retracting the cord, and the device is a spring loaded device. In another further embodiment, the flashlight further comprises a cord holding compartment, and the cord is received within the cord holding compartment. In yet another further embodiment, the first end of the cord is attached to a portion of the cord holding compartment. In still another further embodiment, the cord holding compartment has a hollow interior, and the first end of the cord is attached to a portion of the hollow interior of the cord holding compartment.

In another embodiment, the present invention relates to a flashlight comprising: a housing having an internal cavity leading to an aperture; at least one light bulb, at least one power source and at least one lens; an extendable and retractable cord having first and second ends, the cord is scrollably received within a portion of the internal cavity of the housing, the first end of said cord is attached to a portion of the internal cavity of the housing and the second end extending through the aperture; and an attachment device connected to the second end of the cord.

BRIEF DESCRIPTION OF THE DRAWINGS

The accompanying drawings are included to provide a further understanding of the present invention. These drawings are incorporated in and constitute a part of this specification, illustrate one or more embodiments of the present invention and together with the description, serve to explain the principles of the present invention.

Figure 1:
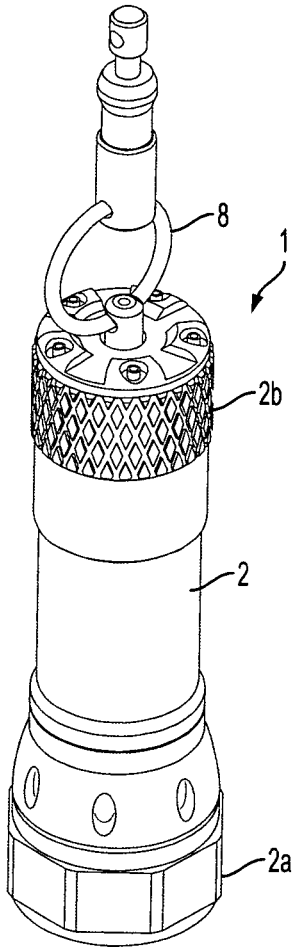
FIG. 1 is perspective view of the flashlight of the present invention with the retracted cord and attachment device.
Figure 2:
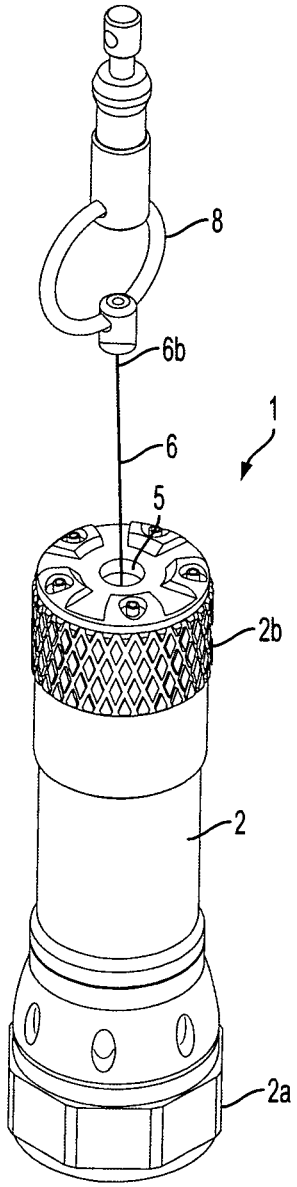
FIG. 2 is perspective view of FIG. 1 with the cord in an extended position.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

FIGS. 1-8 illustrate the flashlight 1 of the present invention. The flashlight 1 comprises a housing 2 having top and bottom portions, 2*a* and 2*b* respectively, and an internal cavity 3. The top portion 2*a* comprises at least one light bulb 4. The bottom portion 2*b* comprises at least one aperture 5, and the internal cavity 3 of the housing 2 leading to the aperture 5. The flashlight 1 further comprises a power source compartment 6 situated within the internal cavity 3 of the housing 2; an extendable and retractable cord 6 having opposing ends, 6*a* and 6*b* respectively; at least one cord holding compartment 7 situated with the internal cavity 3 of the housing 2 and adjacent to the bottom portion 2*b* of the housing 2. The cord 6 is scrollably received within the cord holding compartment 7, one end of the cord 6*a* is attached to a portion of the cord holding compartment 7 and the other end 6*b* extending through the aperture 5 and receiving an attachment device 8 such as a ring.

The top portion 2*a* of the housing 2 comprises at least one lens 10 to allow light emitted by the bulb 4 to be shined by the flashlight 1. The flashlight further comprises a reflector 11 situated adjacent the bulb 4 to further amply and reflect light emitted by the bulb 4.

Figure 3:
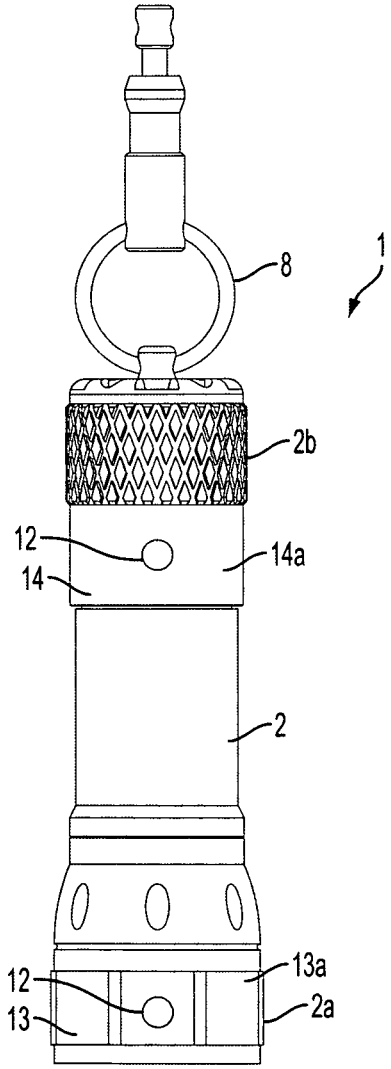
FIG. 3 is a side view of FIG. 1.
Figure 4:
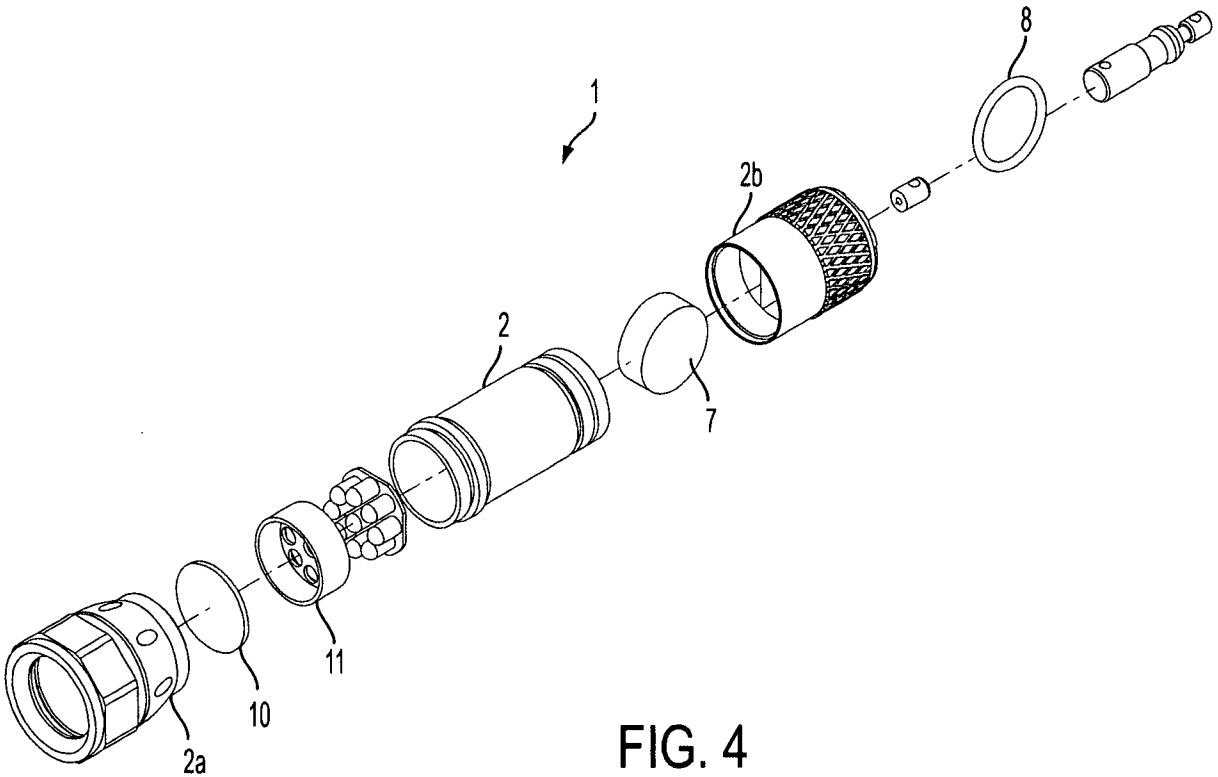
FIG. 4 is an exploded perspective view of the flashlight of the present invention.
Figure 5:
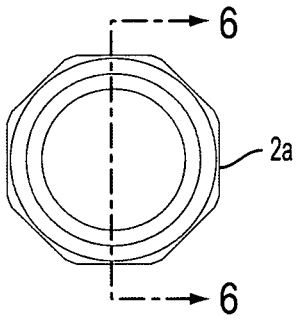
FIG. 5 is a rear view of flashlight.
Figure 6:
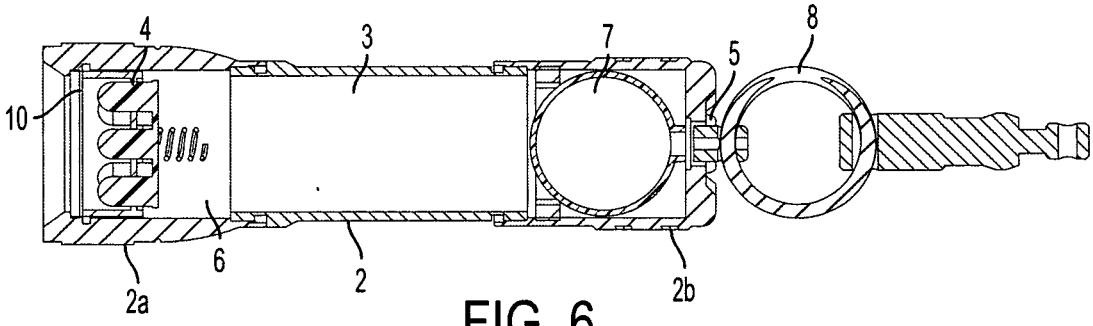
FIG. 6 is a cross sectional view of FIG. 5 across 6-6.

Referring now to FIG. 3, the flashlight 1 further comprises at least one magnet 12. The housing 2 may comprises an extended top portion 13, and the magnet 12 is attached to an external surface 13*a* of the extended top portion 13. The housing 2 may comprises an extended bottom portion 14, and the magnet 12 is attached to an external surface 14*a* of the extended bottom portion 14.

Figure 7:
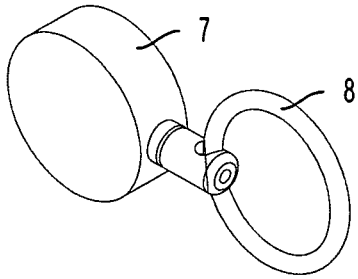
FIG. 7 is a perspective view of the cord holding compartment with the cord in a retracted position.
Figure 8:
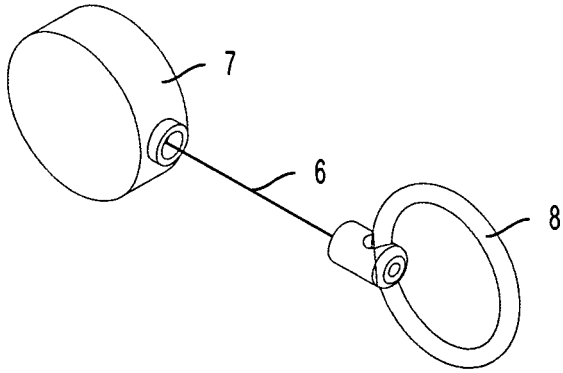
FIG. 8 is a perspective view of FIG. 7 with the cord in an extended position.

Referring to FIGS. 7-8, the flashlight 1 further comprises a cord holding compartment 7, and the cord 6 is scrollably received within the cord holding compartment 7. The cord holding compartment 7 may have a spring loaded device to allow for the extension and retraction of the cord 6. The first end 6*a* of the cord 6 is attached to a portion of the cord holding compartment 7. The cord holding compartment 7 may have a hollow interior, and the first end 6*a* of the cord 6 is attached to a portion of the hollow interior of the cord holding compartment 7.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A flashlight comprising:

a housing having top and bottom portions and an internal cavity, said top portion comprising at least one light bulb, said bottom portion comprising at least one aperture, said internal cavity of said housing leading to said aperture;

a power source compartment situated within said internal cavity of said housing; an extendable and retractable cord having opposing ends;

at least one cord holding compartment situated with said internal cavity of said housing and adjacent to said bottom portion of said housing, said cord being scrollably received within said cord holding compartment, one end of said cord being attached to a portion of said cord holding compartment and said other end extending through said aperture and receiving an attachment device;

at least two rings, a first ring situated adjacent said top portion of said housing and a second ring situated adjacent said bottom portion of said housing, each of said rings are designed to independently rotate about an axis running the length of said housing; and at least two magnets, a first magnet attached to said first ring and a second magnet attached to a second ring, said first and second rings are rotated until said magnets are aligned with one another before magnetically attaching said flashlight to a metal surface.

2. The flashlight of claim 1 wherein said bottom portion of said housing comprises a bottom surface, said aperture being situated on said bottom surface of said bottom portion of said housing.

3. The flashlight of claim 1 wherein said top portion of said housing comprises at least one transparent lens to allow light emitted by said bulb to be shined by said flashlight.

4. The flashlight of claim 1 wherein said top portion of said housing comprises at least one translucent lens to allow light emitted by said bulb to be shined by said flashlight.

5. The flashlight of claim 1 further comprising a reflector situated adjacent said bulb to further amply and reflect light emitted by said bulb.

6. The flashlight of claim 1 further comprising at least one on/off button situated on said surface of said housing, at least one power source, said power source is a battery.

7. The flashlight of claim 1 wherein said first ring comprises an external surface, said first magnet is situated on said external surface of said first ring.

8. The flashlight of claim 1 wherein second ring comprises an external surface, said second magnet is situated on said external surface of said second ring.

9. A flashlight comprising:

a housing having top and bottom portions and an internal cavity leading to an aperture, said top portion comprising a light bulb;

a power source compartment situated within said internal cavity of said housing; an extendable and retractable cord having first and second ends, said cord being scrollably received within a portion of said internal cavity of said housing, said first end of said cord being attached to a portion of said internal cavity of said housing and said second end extending through said aperture;

at least two rings, a first ring situated adjacent said top portion of said housing and a second ring situated adjacent said bottom portion of said housing, said first ring is stationary, said second ring is designed to freely rotate about an axis running the length of said housing; and at least two magnets, a first magnet attached to said first ring and a second magnet attached to a second ring, said second ring is rotated until said second magnet is aligned with said first magnet before magnetically attaching said flashlight to a metal surface; and an attachment device connected to said second end of said cord.

10. The flashlight of claim 9 further comprising a cord holding compartment, said cord being received within said cord holding compartment.

11. The flashlight of claim 10 wherein said first end of said cord is attached to a portion of said cord holding compartment.

12. The flashlight of claim 11 wherein said cord holding compartment has a hollow interior, said first end of said cord is attached to a portion of said hollow interior of said cord holding compartment.

13. A flashlight comprising:

a housing having an internal cavity leading to an aperture; at least one light bulb, at least one power source and at least one lens;

an extendable and retractable cord having first and second ends, said cord being scrollably received within a portion of said internal cavity of said housing, said first end of said cord being attached to a portion of said internal cavity of said housing and said second end extending through said aperture; and an attachment device connected to said second end of said cord at least two rings, a first ring situated adjacent said top portion of said housing and a second ring situated adjacent said bottom portion of said housing, said second ring is stationary, said first ring is designed to freely rotate about an axis running the length of said housing; and at least two magnets, a first magnet attached to said first ring and a second magnet attached to a second ring, said first ring is rotated until said first magnet is aligned with said second magnet before magnetically attaching said flashlight to a metal surface; and an attachment device connected to said second end of said cord.

* * * * *